US008903293B2

(12) United States Patent
Yonemoto

(10) Patent No.: US 8,903,293 B2
(45) Date of Patent: Dec. 2, 2014

(54) FUSER DEVICE AND IMAGE FORMING APPARATUS PROVIDED WITH SAME

(75) Inventor: Satoru Yonemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 165 days.

(21) Appl. No.: 13/601,257

(22) Filed: Aug. 31, 2012

(65) Prior Publication Data

US 2013/0064584 A1 Mar. 14, 2013

(30) Foreign Application Priority Data

Sep. 8, 2011 (JP) ..... 2011-195711

(51) Int. Cl.
*G03G 15/20* (2006.01)

(52) U.S. Cl.
CPC ..... *G03G 15/2067* (2013.01)
USPC ..... 399/328; 399/33; 399/67; 399/122; 399/320

(58) Field of Classification Search
USPC ..... 399/33, 67, 122, 320, 328
See application file for complete search history.

(56) References Cited

U.S. PATENT DOCUMENTS

2005/0141932 A1* 6/2005 Sugiyama ..... 399/328
2007/0223977 A1* 9/2007 Matsubara et al. ..... 399/329
2009/0067866 A1* 3/2009 Nakamura ..... 399/67
2009/0297196 A1* 12/2009 Yamanaka et al. ..... 399/328
2012/0027477 A1* 2/2012 Nakayama ..... 399/328
2012/0114352 A1* 5/2012 Miyoshi ..... 399/67

FOREIGN PATENT DOCUMENTS

JP 2005-070321 A 3/2005
JP 2010-026447 A 2/2010

OTHER PUBLICATIONS

English Translation for JP-2005-070321 A, published Mar. 17, 2005.
English Translation for JP-2010-026447 A, published Feb. 4, 2010.

* cited by examiner

*Primary Examiner* — Ryan Walsh
(74) *Attorney, Agent, or Firm* — NDQ&M Watchstone LLP

(57) ABSTRACT

A fuser device includes a first motor for rotatably driving one of a heating member and a pressure-applying member, a second motor rotating either in a forward direction or a reverse direction in order to switch a pressure-application-switching mechanism between an applied-pressure state and a released-pressure state, a first detector for detecting whether the first motor is rotating, and a second detector for detecting the forward-direction or reverse-direction rotation of the second motor. The first detector has a first sensor for detecting the rotation of the first detector plate caused to rotate by the first motor. The second detector has a second sensor for detecting changes in the rotational state of the second detector plate caused to rotate in the forward and reverse directions by the second motor. A single sensor constitutes the first sensor and the second sensor.

9 Claims, 7 Drawing Sheets

FUSER DEVICE AND IMAGE FORMING APPARATUS PROVIDED WITH SAME

This application is based on and claims the benefit of priority from Japanese Patent Application No. 2011-195711 filed on Sep. 8, 2011, the contents of which are hereby incorporated by reference.

BACKGROUND

The present disclosure relates to a fuser device such as a photocopier, printer, fax machine, a multifunction machine combining these, or the like; and to an image forming apparatus provided with the same; and, in particular, to a fuser device capable of switching between a state in which pressure is applied to a fuser nip and a state in which pressure upon the fuser nip is released and to an image forming apparatus provided with the same.

There are known in the art roller-type fuser devices, which are provided with a heating roller and a pressure roller that rotate in contact with each other, and belt-type fuser devices, which are provided with an endless heating belt as a heating member. In a belt-type fuser device, for example, heat and pressure are applied to a toner image carried upon a recording medium at a nip between the heating belt and a pressure roller, which are pressed together, fusing the toner image to the recording medium.

Related technologies for enabling the pressure applied at the nip formed by the heating belt and pressure roller of such a fuser device to be varied are known. In a fuser device according to a first related technology, a spring is interposed between the heating belt and the pressure roller, applying a predetermined pressure to the nip. The state of pressure between the heating belt and the pressure roller is capable of being varied through the operation of a pressure releasing member by a variable pressure member receiving motive force from a motor. A sensor detects whether there is a state of pressure between the heating belt and the pressure roller through the upward and downward motion of a flag provided on the pressure releasing member. When the motor is rotatably driven, the pressure releasing member is moved to a predetermined position by the variable pressure member, the state of pressure between the heating belt and the pressure roller is released, and the sensor detects the flag of the pressure releasing member. This configuration allows jammed paper to be removed from the fuser device when the recording medium causes a jam at the nip. Furthermore, the pressure is released at all times other than when an image is being formed, whereby the heating belt and the pressure roller are prevented from being deformed by the pressure exerted by each upon the other.

In certain fuser devices, joule heat is produced by an excess current generated in an inductive heat-generating layer provided on the heating belt by a magnetic field generated by an inductive heating member, causing the heating belt to generate heat via electromagnetic induction. In such fuser devices, the heating belt has low heat capacity. Therefore, there is a risk of the heating belt breaking from excessive heating when the heating belt is heated while stopped. To prevent the heating belt from breaking, the rotation of the heating belt is detected, and heating of the heating belt is stopped when the heating belt is not rotating.

A fuser device according to a second related technology is provided with, for example, an inductive heating member for heating a heating belt by electromagnetic induction disposed facing a fuser roller with the heating belt interposed therebetween, and a rotation detector for detecting the rotation of the heating belt. The rotation detector has a rotation detector plate that rotates integrally with a roller rotatably driven by the fuser roller and has a portion of the circumference thereof cut out, and a photosensor provided with a light-emitting part and a light receiving part disposed on either side of the rotation detector plate. When the heating belt rotates, light from the light-emitting part of the photosensor is detected by the light receiving part every time the cutout of the rotation detector plate passes the light receiving part of the photosensor, thereby allowing the rotation of the heating belt to be detected.

The fuser device according to the first related technology described above is provided with a sensor for detecting whether there is a state of pressure between the heating belt and the pressure roller, and the fuser device according to the second related technology is provided with a photosensor for detecting the rotation of the heating belt. In a fuser device in which the state of pressure between a heating member such as a heating belt and a pressure-applying member such as a pressure roller is variable, it is necessary to have a sensor for detecting whether there is a state of pressure between the heating member and the pressure-applying member, as well as a sensor for detecting the rotation of the heating member; however, a problem is presented in that when, for example, a sensor for detecting the upward/downward motion of a flag as disclosed in the first related technology and a photosensor for detecting the rotation of a rotation detector plate as disclosed in the second related technology are provided separately, the size of the device increases, and manufacturing costs go up.

SUMMARY

An object of the present disclosure is to provide a fuser device in which a detector for detecting whether there is a state of pressure between a heating member and a pressure-applying member, and for detecting the rotation of the heating member, can be provided at low cost without increasing the size of the device; and to provide an image forming apparatus provided with the same.

A fuser device according to an aspect of the present disclosure has a heating member heated by heating means, a pressure-applying member that presses against the heating member and forms a nip, a first drive part having a first motor for rotatably driving one of the heating member and the pressure-applying member, a pressure-application-switching mechanism capable of switching between a state in which pressure is applied to the nip and a state in which the pressure upon the nip is released, a second drive part having a second motor rotating either in a forward direction or a reverse direction in order to switch the pressure-application-switching mechanism between the applied-pressure state and the released-pressure state, a first detector for detecting whether the first drive part is rotating, and a second detector for detecting the forward-direction or reverse-direction rotation of the second drive part. The first detector has a first detector plate, upon which are disposed in the circumferential direction a plurality of first slits capable of transmitting light, the first detector plate being provided upon a first rotating member caused to rotate by the first motor; and a sensor, upon which are disposed a light-emitting part for emitting light and a light receiving part for receiving the light emitted by the light-emitting part, the sensor adapted for detecting, using the light receiving part, the rotation of the first drive part by detecting the light emitted from the light-emitting part as light pulses. The second detector has a second detector plate, upon which is disposed at a predetermined position in the circumferential direction a second slit capable of transmitting light, the second detector plate provided upon a second rotating member caused to rotate in the forward and reverse directions by the second motor; and the second detector is adapted for [detecting] (*1) when the pressure-application-switching mechanism is in the applied-pressure state or the released-pressure state, [whether the nip is in the applied-pressure state or the released-pressure state by] (*1) detecting, using the light receiving part, changes in the light-reception status of the light emitted by the light-emitting part for a predetermined period of time as the second detector plate rotates.

A fuser device according to another aspect of the present disclosure has a heating member heated by heating means, a pressure-applying member that presses against the heating member and forming a nip, a first drive part having a first motor for rotatably driving one of the heating member and the pressure-applying member, a pressure-application-switching mechanism capable of switching between a state in which pressure is applied to the nip and a state in which the pressure upon the nip is released, a second drive part having a second motor rotating either in a forward direction or a reverse direction in order to switch the pressure-application-switching mechanism between the applied-pressure state and the released-pressure state, a first detector for detecting whether the first drive part is rotating, and a second detector for detecting the forward-direction or reverse-direction rotation of the second drive part. The first detector has a first detector plate provided on a first rotating member caused to rotate by the first motor, and a first sensor for detecting the rotation of the first detector plate. The second detector has a second detector plate provided on a second rotating member caused to rotate in the forward and reverse directions by the second motor, and a second sensor for detecting changes in the rotational state of the second detector plate. A single sensor constitutes the first sensor and the second sensor. Further objects of the present disclosure and specific advantages of the present disclosure will become apparent from the description of embodiments given below.

DETAILED DESCRIPTION

Figure 1:
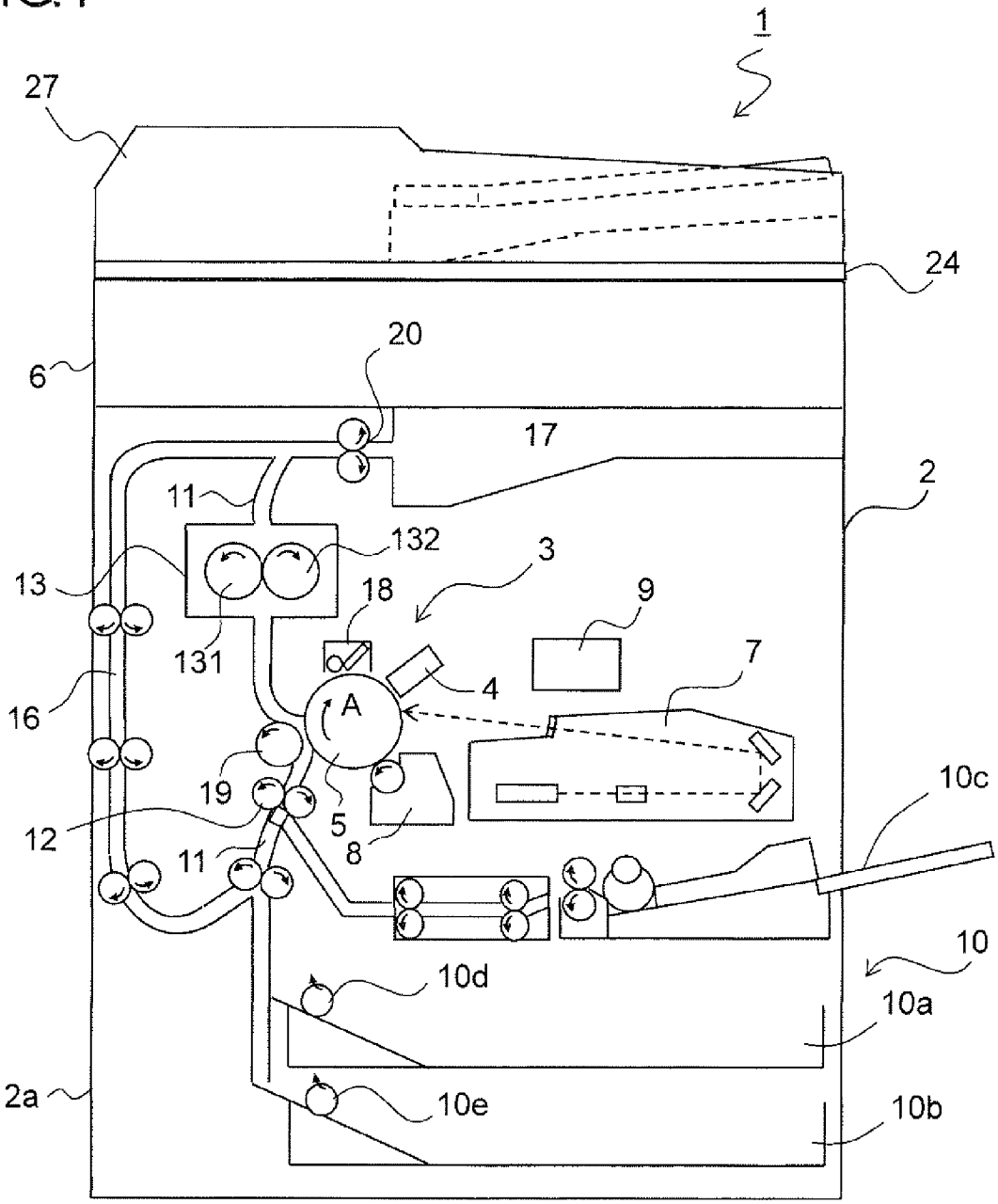
FIG. 1 is an outline of the overall configuration of an image forming apparatus provided with a fuser device according to an embodiment of the present disclosure.

Preferred embodiments of the present disclosure are described below while referring to the drawings, but the present disclosure is not restricted to the following embodiments. The application of the disclosure and the terms and the like indicated herein are not restricted to the following.

FIG. 1 illustrates an overall configuration of an internal-paper-discharging image forming apparatus. In a lower part of an image forming apparatus 1 is disposed a cassette-type paper supply part 10. The paper supply part 10 has upper and lower paper supply cassettes 10*a*, 10*b*, the paper supply cassettes 10*a*, 10*b* containing unprinted paper loaded therein. The paper contained in the paper supply cassettes 10*a*, 10*b* is dispensed one sheet at a time from the selected paper supply cassette 10*a* (or 10*b*) by a paper pickup roller 10*d* (or 10*e*), the dispensed paper being sent out into a paper conveyance path 11.

A manual feed tray 10*c* is disposed on a right side surface of the image forming apparatus 1. Paper of a size different from that of the paper in the paper supply cassettes 10*a*, 10*b* can be placed upon the manual feed tray 10*c*. The paper placed upon the manual feed tray 10*c* is sent out into the paper conveyance path 11.

The paper conveyance path 11 extends upward and downward in an apparatus body 2 to the left of the paper supply part 10. Paper sent out from the paper supply part 10 is conveyed to a resist roller pair 12 in an upper part of the paper conveyance path 11. The resist roller pair 12 sends out paper toward an image forming part 3 in synchronization with the transfer of a toner image onto the paper.

A document reading device 6 is disposed in an upper part of the image forming apparatus 1, an open and closable platen (document restrainer) 24 is provided on an upper surface of the document reading device 6, and a document conveying device 27 is attached above the platen 24. When a document is copied, a document loaded on the document conveying device 27 is sent out one separate sheet at a time to a document reading part, and image data for the read document is created by the document reading device 6.

The image forming part 3 is disposed roughly in the center of the image forming apparatus 1. The image forming part 3 is provided with a photosensitive drum 5 acting as an image-bearing body, as well as an electrostatic part 4, an exposure unit 7, a developer part 8, a transfer roller 19, and a cleaning part 18 in that order around the circumference of the photosensitive drum 5 in the rotational direction (the direction indicated by arrow A in the drawing) thereof. Toner is supplied to the developer part 8 from a toner container 9. The cleaning part 18 has a cleaning member such as a blade, brush, polishing roller, or the like, the cleaning member stripping off and recovering any toner remaining on the surface of the photosensitive drum 5.

When the surface of the photosensitive drum 5 is imparted with a uniform electrostatic charge of a predetermined polarity and electrical potential by the electrostatic part 4, the exposure unit 7 forms a latent electrostatic image of the document on the photosensitive drum 5 on the basis of the image data created by the document reading device 6.

The developer part 8 supplies electrostatically charged toner to the surface of the photosensitive drum 5, and develops the latent electrostatic image on the photosensitive drum 5 to form a toner image. The toner image on the photosensitive drum 5 is transferred onto the paper by the transfer roller 19. The paper onto which the toner image has been transferred is conveyed to a fuser device 13 disposed in an upper part of the paper conveyance path 11. After the toner image has been transferred to the paper, any toner remaining on the surface of the photosensitive drum 5 is cleaned off and recovered by the cleaning part 18, and the residual charge on the surface of the photosensitive drum 5 is removed by a destaticizer not shown in the drawings.

The fuser device 13 has a heating roller 131 and a pressure roller 132, the heating roller 131 and pressure roller 132 applying heat and pressure to the paper onto which the toner image has been transferred, melting and fusing the toner image on the paper. The paper to which the toner image has been fused is conveyed to an upper-right part of the paper conveyance path 11, and ejected by an ejection roller pair 20 into an internal paper discharge part 17 constituting an ejection part.

A reverse conveyance path 16 is provided branching off from the paper conveyance path 11 between the fuser device 13 and the ejection roller pair 20. The reverse conveyance path 16 is used as necessary when a toner image is formed on the other side of the paper after a toner image has been fused to one side of the paper; and covers the periphery of the fuser device 13 from above the fuser device 13, extends downward between the paper conveyance path 11 and a side surface 2*a* of the apparatus body 2, and rejoins the paper conveyance path 11 in the vicinity of the resist roller pair 12.

When double-sided printing is performed, the ejection roller pair 20 are rotated in the reverse direction so as to coincide with the passage of the following edge of the paper to one side of which the toner image has been fused by the branch between the paper conveyance path 11 and the reverse conveyance path 16 while the paper is being ejected onto the internal paper discharge part 17. The direction in which the paper is fed is thereby reversed, and the paper is sent into the reverse conveyance path 16 with the front and rear printing surfaces thereof reversed, and conveyed once more from the reverse conveyance path 16 to the resist roller pair 12 of the paper conveyance path 11. Afterwards, once a toner image has been formed on the other side of the paper by the image forming part 3, the toner image on the paper is fused by the fuser device 13, and the paper is ejected into the internal paper discharge part 17.

Figure 2:
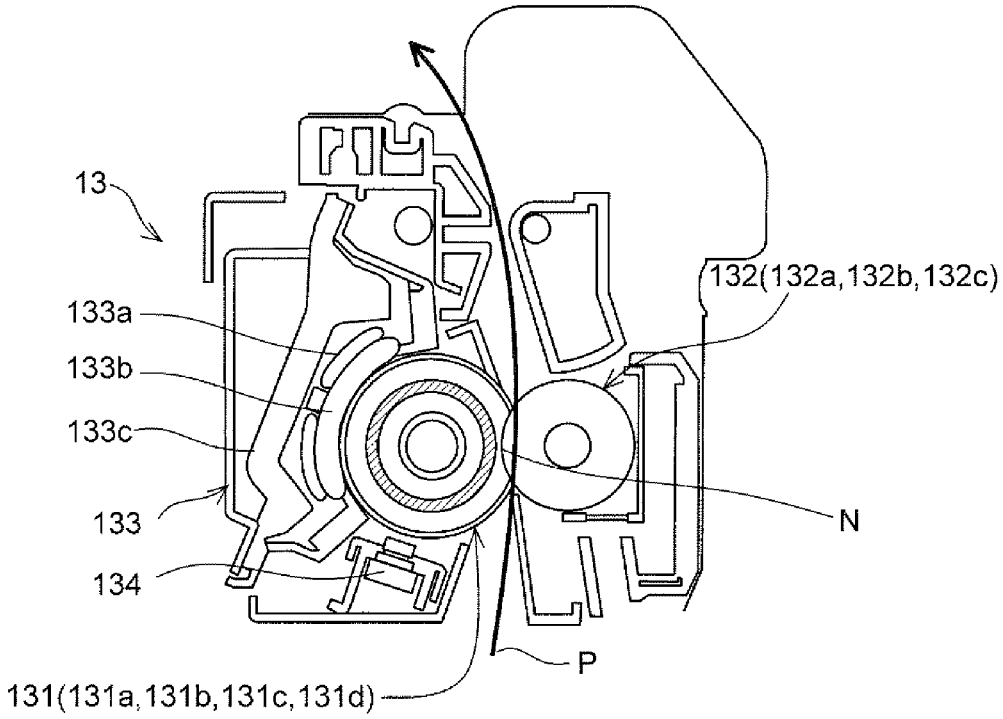
FIG. 2 is a cross-sectional view of a fuser device according to an embodiment of the present disclosure.

FIG. 2 is a cross-sectional view of the circumference of the fuser device 13, as well as a view of the image forming apparatus 1 from FIG. 1 from behind. The fuser device 13 is provided with the heating roller 131 acting as a heating member and the pressure roller 132 acting as a pressure-applying member, as well as an inductive heating member 133 acting as heating means and a temperature sensor 134, which members constitute a fuser part.

The fuser device 13 is of a type utilizing an electromagnetic induction-type heat source, and is provided with the inductive heating member 133 disposed facing the outer periphery of the heating roller 131 and a temperature sensor 134 constituted by a thermistor or the like for detecting the surface temperature of the heating roller 131. The inductive heating member 133 and temperature sensor 134 are fixed in place on the apparatus body 2 and the like, while the heating roller 131 and pressure roller 132 are rotatably held in place on the apparatus body 2.

The heating roller 131 is provided with a cylindrical base 131*a* of stainless steel and an elastic layer 131*d* of a silicone rubber sponge or the like for improving the elasticity and releasability of a nip N formed from the contact with the pressure roller 132, and an insulation layer 131*b* and an inductive heat-generating layer 131*c* are provided in the stated order away from the base between the base 131*a* and the elastic layer 131*d*.

The pressure roller 132 is provided with a base 132*a* formed from an aluminum core, an elastic layer 132*b* of silicone rubber formed upon the base 132*a* in order to impart elasticity to the nip N, and a release layer 132*c* formed from a fluororesin tube covering the surface of the elastic layer 132*b* in order to improve releasability when the unfused toner image is melted and fused at the nip N.

The heating roller 131 is rotatably driven by a motive source (omitted from the drawings) such as a motor or the like, and the pressure roller 132 applies pressure to the heating roller 131 towards the center thereof. The heating roller 131 is thereby pressed against the pressure roller 132, and, when the heating roller 131 rotates, the pressure roller 132 is rotatably driven in the same direction at the nip N.

The temperature sensor 134 is disposed so as to face a paper-passing area of the surface heating roller 131 disposed in the axial-direction center thereof, and two axial-direction end parts thereof constituting areas over which no paper passes when a sheet of small-sized paper or A4 vertical paper passes through; and detects the temperature of each of the areas. The flow of electrical current to the inductive heating member 133 is controlled on the basis of the temperatures detected by the temperature sensor 134, and the surface of the heating roller 131 is kept at a predetermined temperature.

The inductive heating member 133, which heats the heating roller 131 using electromagnetic induction, is disposed extending in the axial direction of the heating roller 131 and facing the heating roller 131 so as to surround a portion of the outer circumference thereof, and is provided with an excitation coil 133*a*, a bobbin 133*b*, and a magnetic core 133*c*.

The excitation coil 133*a* is wrapped around a central part of the magnetic core 133*c* so as describe a spiral in the axial direction of the heating roller 131, and is mounted on top of the bobbin 133*b*. The excitation coil 133*a* is connected to a power source not shown in the drawings, and generates an electromagnetic flux using the high-frequency current supplied from the power source. The electromagnetic flux emitted from the inductive heating member 133 is conducted in a direction parallel to the surface plane of FIG. 2, and penetrates the inductive heat-generating layer 131*c* of the heating roller 131. An excess current is generated around the electromagnetic flux of the inductive heat-generating layer 131*c*, and joule heat is generated within the inductive heat-generating layer 131*c* by electrical resistance when the excess current flows therethrough, heating the heating roller 131.

The inductive heating member 133 is controlled on the basis of the temperatures detected by the temperature sensor 134 so that the heating roller 131 is heated to a predetermined temperature. When the heating roller 131 is heated to a predetermined temperature, paper P sandwiched in the nip N is heated, and the powdered toner upon the paper P is melted and fused from the pressure applied thereto by the pressure roller 132.

Figure 3:
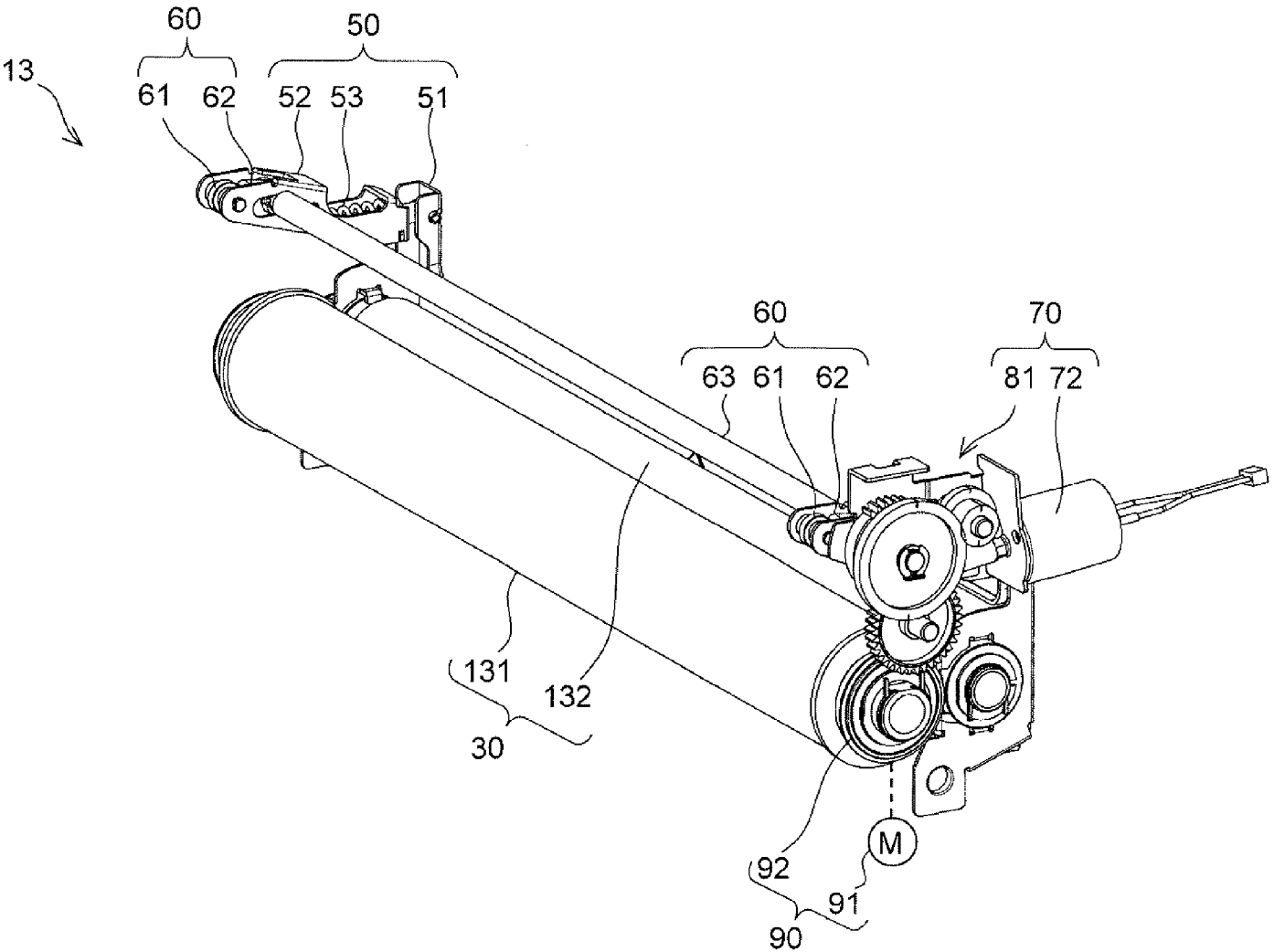
FIG. 3 is a perspective view of a fuser device according to an embodiment of the present disclosure.

FIG. 3 is a perspective view of the fuser device 13. Apart from a fuser part 30 constituted by the heating roller 131, pressure roller 132, and the like described above, the fuser device 13 has a pressure-applying mechanism 50, an pressure-application-switching mechanism 60, a first drive part 90 for rotatably driving the fuser part 30, and a second drive part 70 for driving the pressure-application-switching mechanism 60.

The heating roller 131 and pressure roller 132 are rotatably supported at both ends thereof in the axial direction. The pressure-applying mechanism 50 (the pressure-applying mechanism 50 on the right side of FIG. 3 is not visible) and the pressure-application-switching mechanism 60 are disposed on both ends of the pressure roller 132 in the axial direction. The first drive part 90 is disposed near the right end of the heating roller 131 in the axial direction, and the second drive part 70 is disposed near the pressure-application-switching mechanism 60 on the right side.

The first drive part 90 is provided with a first motor 91, and a fuser gear 92 provided on the right end of the heating roller 131 in the axial direction. When the first motor 91 rotatably drives, the fuser gear 92 rotates, the heating roller 131 is rotated, and the pressure roller 132 is rotatably driven. A first detector 94 described hereafter (cf. FIG. 6) detects whether the heating roller 131 is rotating, and the heating of the heating roller 131 by the inductive heating member 133 (cf. FIG. 2) is stopped on the basis of the detected results when the heating roller 131 is not rotating.

The pressure-applying mechanism 50 presses the pressure roller 132 and the heating roller 131 together, generating nip pressure at the nip N (cf. FIG. 2) formed thereby; and is provided with a first arm member 51, a second arm member 52, and an elastic member 53. Pressure-applying mechanisms 50 are disposed on both ends of the pressure roller 132 in the axial direction.

The pressure-application-switching mechanism 60 varies the urging force applied by the elastic member 53 provided in the pressure-applying mechanism 50, and is provided with an eccentric cam 62, a roller 61 engaging with the eccentric cam 62, and a rotating coupling shaft 63. Eccentric cams 62 and rollers 61 are disposed on both sides of the pressure roller 132 in the axial direction. The rotating coupling shaft 63 forms one piece with the eccentric cams 62 on both sides.

The second drive part 70 is provided with a second motor 72 capable of rotating in the forward direction or reverse direction and a gear train 81 rotated by the second motor 72, and the rotational drive force of the second motor 72 is transmitted to the pressure-application-switching mechanism 60 via the gear train 81. The forward or reverse direction rotational drive force of the second drive part 70 is transmitted to the eccentric cam 62 provided on the right side of the pressure-application-switching mechanism 60, and to the left-side eccentric cam 62 via the rotating coupling shaft 63. The operation of the pair of eccentric cams 62 switches the urging force applied by the elastic members 53 provided in the pressure-applying mechanisms 50 on both sides. Switching the urging force of the elastic members 53 provided in the pressure-applying mechanisms 50 by the pressure-application-switching mechanism 60 thus switches between an applied-pressure state, in which pressure is applied to the nip N, and a released-pressure state, in which the pressure upon the nip N is released.

Figure 4A:
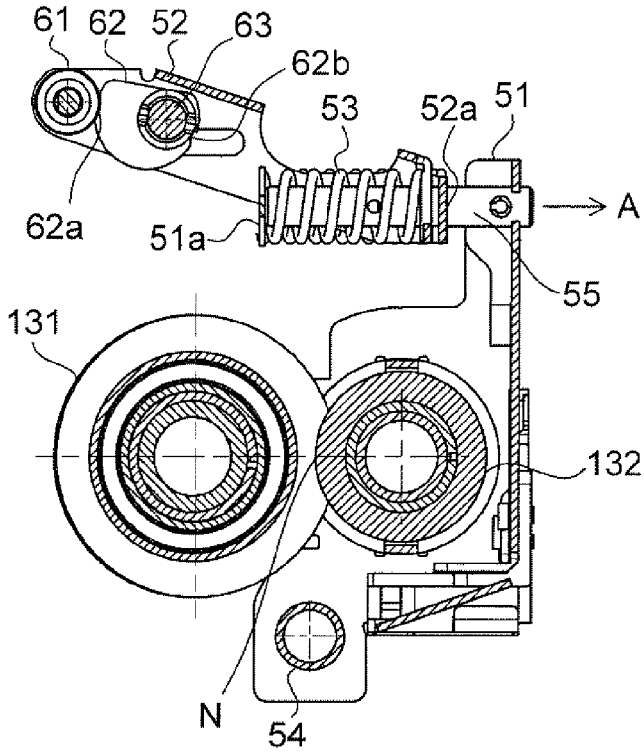
FIG. 4A is a side view of a nip in a fuser device according to an embodiment of the present disclosure in a state in which pressure is being applied thereto.
Figure 4B:
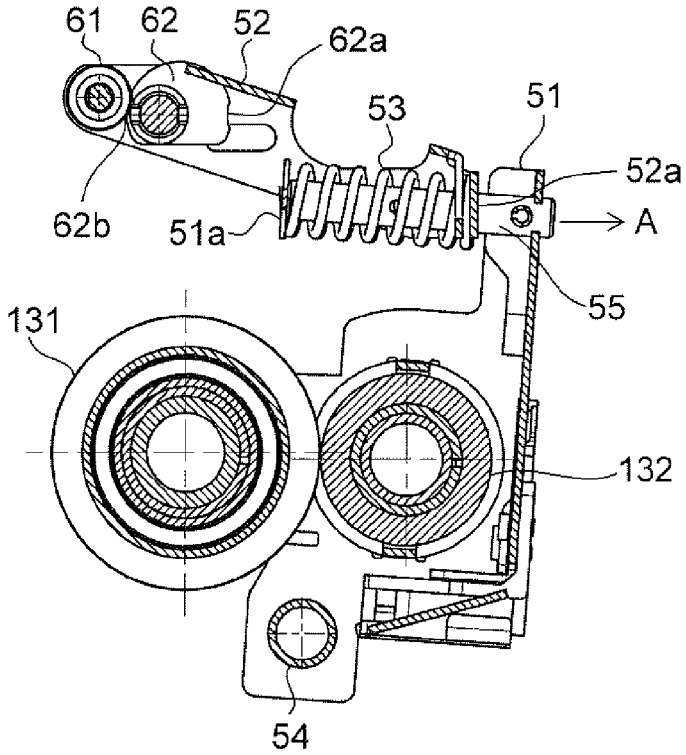
FIG. 4B is a side view of a nip in a fuser device according to an embodiment of the present disclosure in a state in which pressure thereupon has been released.

FIGS. 4A and 4B illustrate the configuration of the pressure-applying mechanism 50 and the pressure-application-switching mechanism 60. FIG. 4A is a side view of the nip N with pressure being applied thereto, and FIG. 4B is a side view of the nip N after the pressure thereupon has been released.

As shown in FIG. 4A, the first arm member 51 of the pressure-applying mechanism 50 is formed from a metal plate of iron or the like having a predetermined shape. The pressure roller 132 is rotatably supported roughly at the center of the first arm member 51. A hole into which a support shaft 54 affixed to the apparatus body is fitted is formed in a lower part of the first arm member 51, and the first arm member 51 is supported centered on the support shaft 54 so as to be swayable to the left and right. One end of a fixed shaft 55 extending to the left is affixed to an upper part of the first arm member 51, and a bent first contact part 51*a* is formed extending leftward from where the fixed shaft 55 is affixed. The first contact part 51*a* has a planar shape, and the other end of the fixed shaft 55 is affixed to the first contact part 51*a*. The elastic member 53 ensheathes the fixed shaft 55, and one end of the elastic member 53 contacts the first contact part 51*a*.

The second arm member 52 is formed from a metal plate of iron or the like having a predetermined shape. A bent planar second contact part 52*a* is formed on a right side of the second arm member 52. The second contact part 52*a* faces the first contact part 51*a* of the first arm member 51, and has a hole through which the fixed shaft 55 penetrates so as to be movable to the left and right with respect to the fixed shaft 55. The other end of the elastic member 53 contacts the second contact part 52*a*.

The elastic member 53 applies pressure to the nip N, and is constituted by a compression coil spring in a contracted state, the ends of which contact the first contact part 51*a* and the second contact part 52*a*. Therefore, a leftward urging force operates upon the first contact part 51*a* and a rightward urging force operates upon the second contact part 52*a*, so that the first contact part 51*a* and the second contact part 52*a* are urged apart from each other by the elastic member 53, thereby pressing the pressure roller 132 against the heating roller 131.

The second arm member 52 extends to the left from the second contact part 52*a*, and the cylindrical roller 61 is rotatably attached to the left end thereof The eccentric cam 62 engages with the roller 61. The eccentric cam 62 is rotatably drivable around the rotational center of the rotating coupling shaft 63 (cf. FIG. 3) along with the rotating coupling shaft 63, and is formed so that the distance from the axis of rotation thereof to the outer edge thereof varies along the circumference thereof. A concave first indentation 62*a* and second indentation 62*b* are formed in the outer edge of the eccentric cam 62. The first indentation 62*a* and second indentation 62*b* are provided at different positions on the circumferential surface with respect to the rotational center, and the distance of the first indentation 62*a* from the rotational center is set so as to be greater than the distance of the second indentation 62*b* from the rotational center. The first indentation 62*a* and second indentation 62*b* are capable of engaging with the roller 61, and the rotation of the rotating coupling shaft 63 by the second drive part 70 (cf. FIG. 3) switches between the state shown in FIG. 4A, in which the first indentation 62*a* is engaged with the roller 61, and the state shown in FIG. 4B, in which the second indentation 62*b* is engaged with the roller 61.

When the first indentation 62*a* is engaged with the roller 61 as shown in FIG. 4A, there is a predetermined distance between the second contact part 52*a* of the second arm member 52 and the first contact part 51*a* of the first arm member 51, and the elastic member 53 contracts a predetermined amount. When the second indentation 62*b* is engaged with the roller 61 as shown in FIG. 4B, as opposed to the state shown in FIG. 4A, the second arm member 52 shifts position to the right, the distance between the second contact part 52*a* and the first contact part 51*a* increases, and the elastic member 53 extends.

Thus, in the state shown in FIG. 4A, there is a state of pressure between the heating roller 131 and pressure roller 132. On the other hand, in the state shown in FIG. 4B, the urging force applied by the elastic member 53 is smaller than in FIG. 4A, and the state of pressure between the heating roller 131 and the pressure roller 132 has been released. In the state shown in FIG. 4B, because the pressure upon the nip N has been released, the first arm member 51 is rotatably driven slightly to the right centered upon the support shaft 54.

The first and second indentations 62*a*, 62*b* of the eccentric cam 62 are disposed at opposite positions (positions 180° apart) with respect to the rotational center. Thus, when the eccentric cam 62 rotates 180° in the forward direction, the first indentation 62*a* engages with the roller 61 and the applied-pressure state is entered (cf. FIG. 4A), and when the eccentric cam 62 rotates 180° in the reverse direction, the second indentation 62*b* engages with the roller 61 and the released-pressure state is entered (cf. FIG. 4B).

Figure 5:
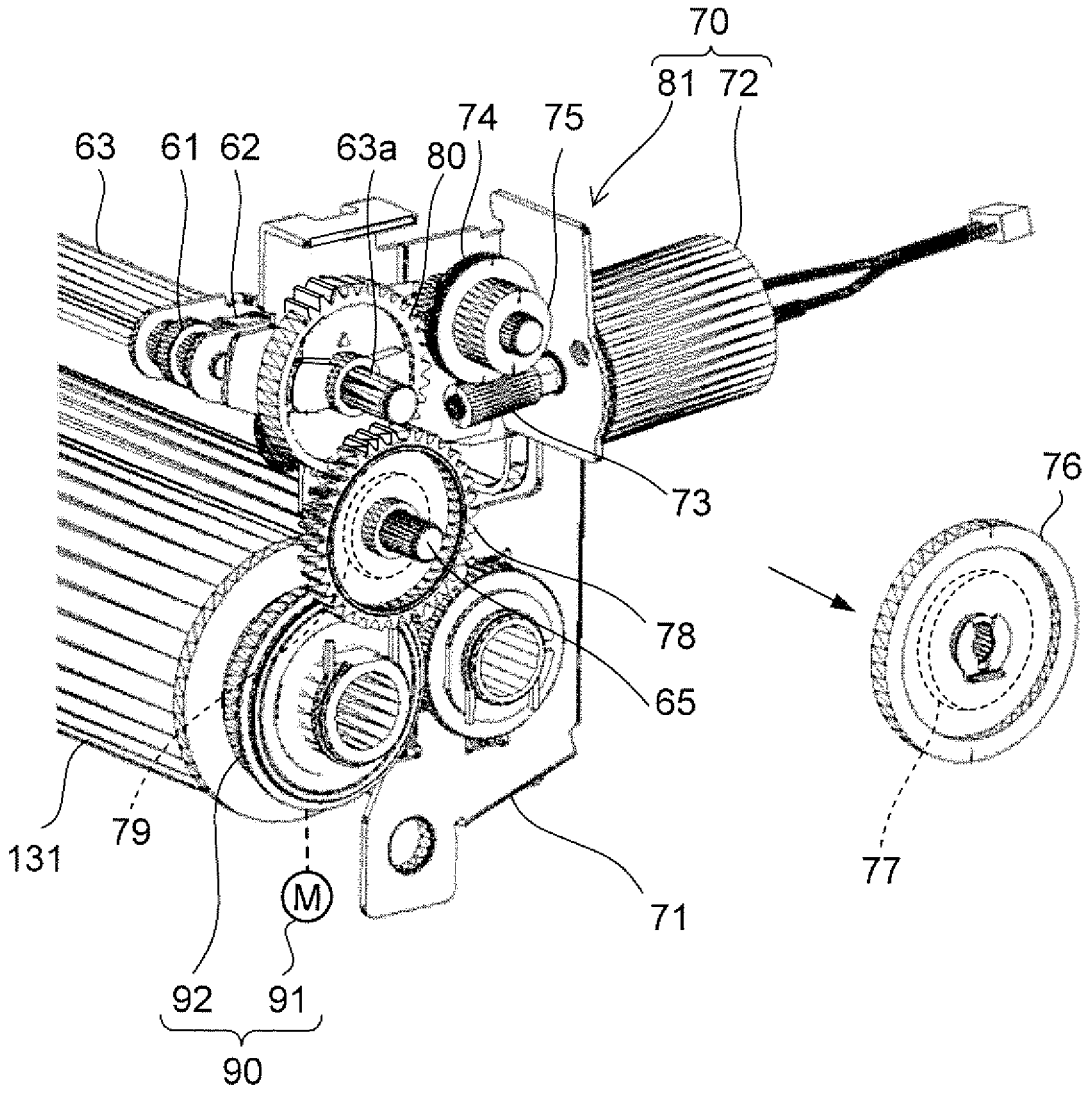
FIG. 5 is a perspective view of a first drive part and a second drive part of a fuser device according to an embodiment of the present disclosure.
Figure 6:
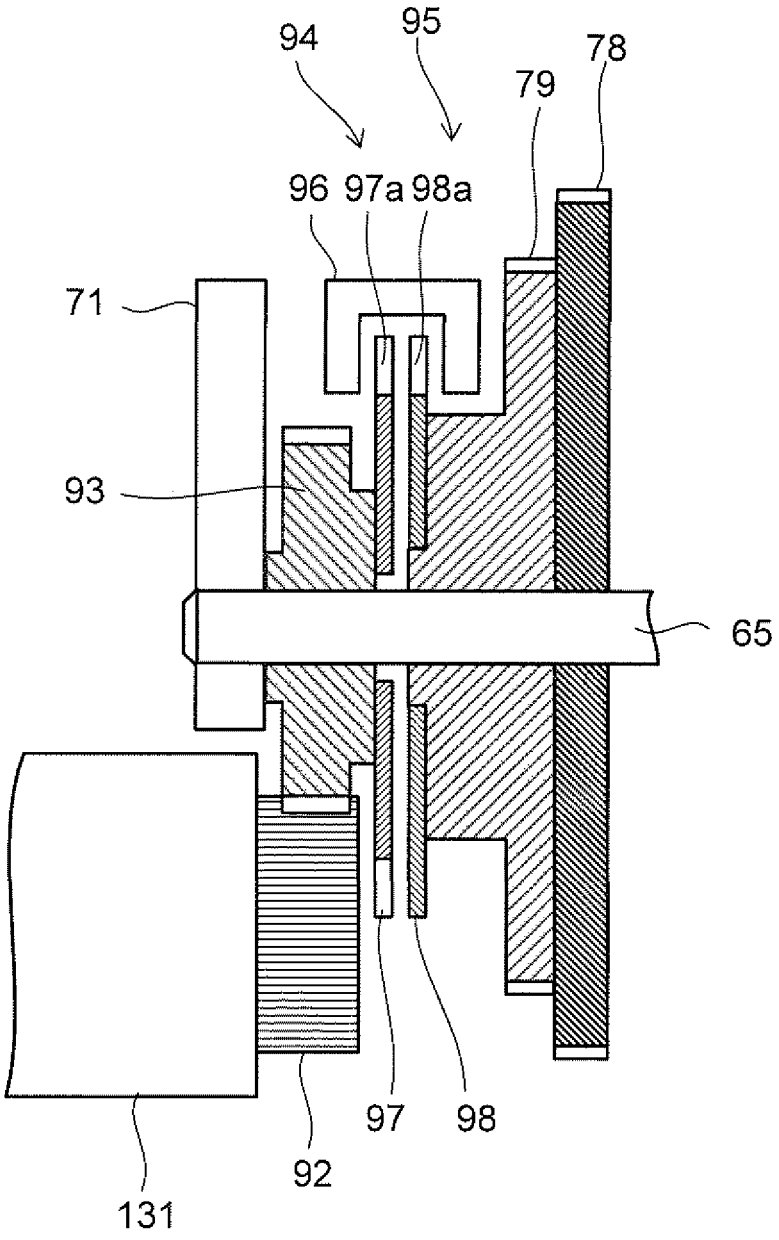
FIG. 6 is a cross-sectional view of a first detector and a second detector of a fuser device according to an embodiment of the present disclosure.
Figure 7:
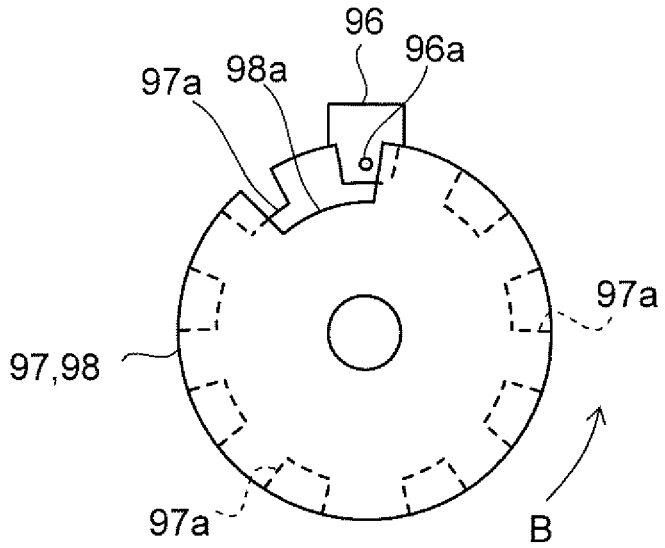
FIG. 7 is a plan view of a first detector and a second detector when pressure is being applied to a nip of a fuser device according to an embodiment of the present disclosure.
Figure 8:
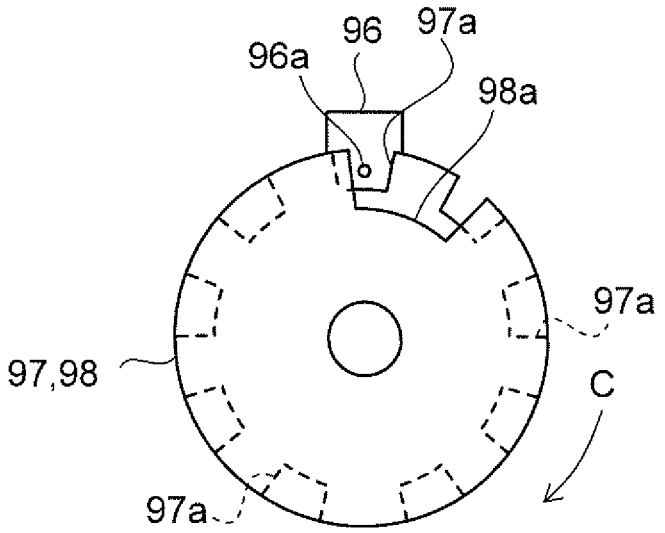
FIG. 8 is a plan view of a first detector and a second detector when pressure upon a nip of a fuser device according to an embodiment of the present disclosure has been released.

The second drive part 70, which rotates the eccentric cam 62 in the forward direction or the reverse direction, and the second detector, which detects the forward or reverse direction rotation of the second drive part 70, will be described in detail with reference to FIGS. 5 through 8. FIG. 5 is a perspective view of the first and second drive parts, and FIG. 6 is a cross-sectional view of the first and second detectors. FIGS. 7 and 8 are plan views of the first and second detectors, with FIG. 7 showing a state in which pressure is applied to the nip, and FIG. 8 showing a state in which the pressure upon the nip is released. For convenience of description, gears 76, 77 are removed from the gear train in FIG. 5.

As shown in FIG. 5, the first drive part 90 is provided with the first motor 91, constituted by a DC motor rotatably driving in one direction, and the fuser gear 92, integrally provided with the heating roller 131 and rotatably driven by the first motor 91. The second drive part 70 is provided with a second motor 72, a motor gear 73, a gear train 81, and a bed plate 71 affixed to the apparatus body.

The second motor 72 is constituted by a DC motor, and is attached to the bed plate 71. The motor gear 73, which is constituted by a worm gear, is attached to a rotating shaft of the second motor 72. When the second motor 72 is rotated in the forward or reverse direction by a motor drive circuit not shown in the drawings, the gear train 81 (gears 74-80) rotates in the forward or reverse direction, and the eccentric cam 62 (cf. FIG. 4) is rotated in the forward direction or the reverse direction via the rotating coupling shaft 63.

Specifically, the gear train 81 has a first gear 74 constituted by a wheel gear meshing with the motor gear 73, a second gear 75 constituted by a spur gear, a third gear 76, and fourth gear 77, a fifth gear 78, a sixth gear 79, and a seventh gear 80; and the rotational drive force of the second motor 72 is transmitted in order to the first through the seventh gears 74-80.

The first and second gears 74, 75 are integral with the rotating shaft, and are rotatably supported by the bed plate 71. The third gear 76 meshes with the second gear 75, and is integral with the fourth gear 77. The third and fourth gears 76, 77 are rotatably supported by a rotating shaft 63*a* extending from the rotating coupling shaft 63. The fifth gear 78 meshes with the fourth gear 77, and is integral with the sixth gear 79. The fifth and sixth gears 78, 79 are integral with a shaft member 65 rotatably supported by the bed plate 71. The seventh gear 80 meshes with the sixth gear 79, and is integral with the rotating shaft 63*a*.

When the second motor 72 rotates a predetermined number of times in the forward direction starting from the state in which the pressure upon the nip N is released, i.e., the second indentation 62*b* of the eccentric cam 62 is engaged with the roller 61 (cf. FIG. 4B), the seventh gear 80 rotates 180°, and the roller 61 switches from engaging with the second indentation 62*b* of the eccentric cam 62 to engaging with the first indentation 62*a* (cf. FIG. 4A), and pressure is applied to the nip N. On the other hand, when the second motor 72 rotates a predetermined number of times in the reverse direction starting from the state in which pressure is placed upon the nip N, i.e., the first indentation 62*a* of the eccentric cam 62 is engaged with the roller 61 (cf. FIG. 4A), the seventh gear 80 rotates 180° in the reverse direction, and the roller 61 switches from engaging with the first indentation 62*a* of the eccentric cam 62 to engaging with the second indentation 62*b* (cf. FIG. 4B), and the pressure is released from the nip N. It is also acceptable to set the reduction ratio of the gear train 81 as appropriate and set the switching rotation angle of the seventh gear 80 to an angle other than 180° and less than 360° in lieu of a configuration in which the seventh gear 80 rotates 180° in order to switch between the applied-pressure state and the released-pressure state.

As shown in FIG. 6, the first detector 94 detects whether the first drive part 90 is rotating, and has a first detector plate 97 and a sensor 96. A second detector 95 is adapted for detecting the rotation of the second drive part 70 to a predetermined position in the forward direction or reverse direction, and has a second detector plate 98 and the sensor 96. The sensors 96 for the first and second detectors 94, 95 are constituted by a single sensor. Such a configuration enables the first and second detectors 94, 95 to be provided at low cost without the size of the first and second detectors 94, 95 being increased.

The first detector plate 97 of the first detector 94 has a first slit 97*a* on the outer edge thereof, and is circular in shape. A plurality of first slits 97*a* of a predetermined pitch are formed around the entire circumference (cf. FIG. 7). The first slits 97*a* can be sections cut out of the outer edge of the first detector plate 97, or openings that have not been cut out.

The first detector plate 97 is integrally attached to a detector gear 93, which acts as the first rotating member. The detector gear 93 meshes with the fuser gear 92, and is rotatably attached to the shaft member 65 provided on the fifth and sixth gears 78, 79. When the first motor 91 (cf. FIG. 5) rotatably drives so as to rotate the heating roller 131, the detector gear 93 is caused to rotate via the fuser gear 92. The rotation of the detector gear 93 rotates the first detector plate 97 in a predetermined direction.

The sensor 96 has a U-shaped cross section, and has a light emitting unit (not shown in the drawings) for emitting light from one end of the U shape, and a light receiving unit 96*a* (cf. FIG. 7), provided on the other end of the U shape, for receiving the light emitted by the light emitting unit. The first slit 97*a* of the first detector plate 97 is disposed between the light emitting unit of the sensor 96 and the light receiving unit 96*a*.

Thus, when the fuser gear 92 rotates, the first detector plate 97 causes the circumference of the shaft member 65 to rotate via the detector gear 93. Whenever the plurality of first slits 97*a* pass the light receiving unit 96*a* due to the rotation of the first detector plate 97, the light receiving unit 96*a* receives light from the light emitting unit. When the light receiving unit 96*a* receives light, the sensor 96 detects a light pulse from the first slit 97*a*. When the first detector 94 detects this light pulse, the first drive part 90 and heating roller 131 are determined to be rotating. On the other hand, when the first detector 94 does not detect a light pulse for a predetermined time or more, the first drive part 90 and heating roller 131 are determined to be stopped, and the heating of the heating roller 131 by the inductive heating member 133 (cf. FIG. 2) is stopped.

The second detector plate 98 of the second detector 95 is integrally attached to the sixth gear 79, which acts as the second rotating member. As described above, the sixth gear 79 is integral with the shaft member 65 along with the fifth gear 78, meshes with the seventh gear 80 (cf. FIG. 5) rotating the eccentric cam 62 (cf. FIG. 5) in the forward or reverse direction, and rotates the seventh gear 80 180° in the forward or reverse direction. The sixth gear 79 and seventh gear 80 are set to a predetermined reduction ratio, and the sixth gear 79 rotates, for instance, 320° in the forward or reverse direction in order to rotate the seventh gear 80 180° in the forward or reverse direction. The rotation of the sixth gear 79 causes the second detector plate 98 to rotate 320° in the forward or reverse direction. Because the sixth gear 79 and detector gear 93 are configured so as to be independently rotatable around the same axis, when the second detector plate 98 rotates in the forward or reverse direction, the first detector plate 97 does not rotate along therewith, and the second detector plate 98 does not rotate along therewith when the first detector plate 97 rotates.

The second detector plate 98 has a second slit 98*a* on an outer edge thereof and a circular shape, and is disposed near the first detector plate 97 in opposition thereto. The second slit 98*a* of the second detector plate 98 is disposed between the light emitting unit of the sensor 96 and the light receiving unit 96*a* along with the first slit 97*a* of the first detector plate 97. Having the first detector plate 97 and the second detector plate 98 disposed near to each other reduces the size of the sensor 96 shared by the first detector 94 and the second detector 95.

As shown in FIG. 7, one second slit 98*a* is formed at a predetermined position in the circumferential direction of the second detector plate 98. The second slit 98*a* has a predetermined width in the circumferential direction in order to allow detection of the applied-pressure state and released-pressure state of the nip N. Specifically, when the nip N is in the applied-pressure state or released-pressure state, the light receiving unit 96*a* of the sensor 96 receives the light from the light emitting unit through the second slit 98*a*; and the width of the second slit 98*a* is such that, when the second detector plate 98 is rotating accompanying a switch to the applied-pressure state or the released-pressure state, the second detector plate 98 blocks the light from the light emitting unit of the sensor 96 from reaching the light receiving unit 96*a*. In the present embodiment, the detection light from the sensor 96 is blocked for the amount of time taken for the second detector plate 98 to rotate 320° in the forward or reverse direction. When the rotational angle of the second detector plate 98 is set, for example, 180° smaller, two second slits 98*a* may be provided in positions corresponding to the applied-pressure state and the released-pressure state. When the width of the second slit 98*a* in the circumferential direction is equal to or greater than the width of the first slit 97*a* in the circumferential direction, the rotational angle of the sixth gear 79 can be set as appropriate. The second slit 98*a* can be a section cut out of the outer edge of the second detector plate 98, or an opening that has not been cut out.

In the configuration described above, the light receiving unit 96*a* of the sensor 96 receives light emitted by the light emitting unit through the second slit 98*a* in the applied-pressure state shown in FIG. 7. The second drive part 70 then drives so as to switch to the released-pressure state, and the second detector plate 98 concurrently rotates a predetermined amount (320°) in the direction of arrow B. While the second detector plate 98 is rotating, the light emitted by the light emitting unit of the sensor 96 is blocked by the second detector plate 98, and the light receiving unit 96*a* does not receive the light emitted from the light emitting unit. When the second detector plate 98 rotates a predetermined amount (320°), the second slit 98*a* arrives at a position opposing the light receiving unit 96*a*, and the light receiving unit 96*a* detects light passing through the second slit 98*a*, as shown in FIG. 8. When the second detector 95 detects light passing through the slit of the second detector plate 98 after the amount of time for the second detector plate 98 to rotate a predetermined amount) (320°) has passed, a switch from the applied-pressure state to the released-pressure state is determined, and the second motor 72 stops rotatably driving.

Meanwhile, in the released-pressure state shown in FIG. 8, the light receiving unit 96*a* of the sensor 96 receives light emitted by the light emitting unit through the second slit 98*a*. The second drive part 70 then drives so as to switch to the applied-pressure state, and the second detector plate 98 concurrently rotates a predetermined amount (320°) in the direction of arrow C. While the second detector plate 98 is rotating, the light emitted by the light emitting unit of the sensor 96 is blocked by the second detector plate 98, and the light receiving unit 96*a* does not receive the light emitted from the light emitting unit. When the second detector plate 98 rotates a predetermined amount (320°), the second slit 98*a* arrives at a position opposing the light receiving unit 96*a*, and the light receiving unit 96*a* detects light passing through the second slit 98*a*, as shown in FIG. 7. When the second detector 95 detects light passing through the slit of the second detector plate 98 after the amount of time for the second detector plate 98 to rotate a predetermined amount (320°) has passed, a switch from the released-pressure state to the applied-pressure state is determined, and the second motor 72 stops rotatably driving.

Because the detection light from the sensor 96 is blocked by the second detector plate 98 when the second detector plate 98 is rotating concurrently with a switch to the applied-pressure state or the released-pressure state, the first detector 94 cannot detect light pulses passing through the first slit 97*a*, even if the heating roller 131 is rotating. However, because the embodiment is configured so that the heating roller 131 is determined to be stopped when the first detector 94 does not detect light pulses for a predetermined amount of time, i.e., the amount of time the second detector plate 98 is rotation, or longer, and the heating of the heating roller 131 by the inductive heating member 133 (cf. FIG. 2) is stopped, the heating roller 131 is heated by the inductive heating member 133 even when the apparatus is switching to the applied-pressure state or the released-pressure state.

The embodiment described above is an example of an application to a roller-type fuser device, but the present disclosure is not restricted to this, and may also be applied to a belt-type fuser device using an endless fuser belt as a heating member, or to a fuser device in which the heating member has a fixedly supported heating body and a heat resistant film sliding in close contact with the heating body, and the heating body and a pressure roller are pressed together with the heat resistant film interposed therebetween. A heater may also be used as a heat source, or a pressure-applying mechanism may be provided by a heating member.

The above embodiment has a configuration in which the first detector plate 97 is integrally attached to the detector gear 93, but the present disclosure is not restricted to this, and a configuration in which the first detector plate 97 is attached to the fuser gear 92 or another of the rotating members transmitting the rotational drive force of the first motor 91 rotating the heating roller 131 is also acceptable. In the above configuration, the second detector plate 98 is integrally attached to the sixth gear 79, but the present disclosure is not restricted to this; the second detector plate 98 may also be attached to another gear, such as the seventh gear 80, of the gear train 81 set to rotate no more than one full rotation. It is also acceptable to provide a detector gear for attaching the second detector plate 98, the detector gear receiving forward or reverse rotational force transmitted from the gear train 81.

In the above embodiment, the light emitting unit and light receiving unit 96*a* was disposed on either side of the first and second detector plates 97, 98, and the light receiving unit 96*a* received light passing through the first slit 97*a* and light passing through the second slit 98*a*; however, the present disclosure is not restricted to this, and a configuration in which the light emitting unit and light receiving unit 96*a* are disposed in a line with respect to the first or second detector plate 97, 98, the light receiving unit 96*a* receives that light, out of the light emitted by the light emitting unit, reflecting off of the first detector plate 97, and the light receiving unit 96*a* also receives light reflecting off of the second detector plate 98. In this case as well, the same effects as for the embodiment described above are yielded. The sensor 96 may also mechanically or magnetically detect the rotation of the first and second detector plates 97, 98.

The present disclosure may be used for a fuser device such as a photocopier, printer, fax machine, a multifunction machine combining these, or the like and to an image forming apparatus provided with the same; and, in particular, to a fuser device capable of switching between a state in which pressure is applied to a fuser nip and a state in which pressure upon the fuser nip is released and to an image forming apparatus provided with the same.

What is claimed is:

1. A fuser device comprising:

a heating member heated by heating means;

a pressure-applying member that presses against the heating member and forms a nip;

a first drive part having a first motor for rotatably driving one of the heating member and the pressure-applying member;

a pressure-application-switching mechanism capable of switching between a state in which pressure is applied to the nip and a state in which the pressure on the nip is released;

a second drive part having a second motor rotating either in a forward direction or a reverse direction in order to switch the pressure-application-switching mechanism between the applied-pressure state and the released-pressure state;

a first detector for detecting whether the first drive part is rotating; and a second detector for detecting the forward-direction or reverse-direction rotation of the second drive part;

the first detector having a first detector plate, on which are disposed in the circumferential direction a plurality of first slits capable of transmitting light, the first detector plate being provided on a first rotating member caused to rotate by the first motor; and a sensor, on which are disposed a light-emitting part for emitting light and a light receiving part for receiving light emitted by the light-emitting part, the sensor adapted for detecting the rotation of the first drive part by detecting, using the light receiving part, the light emitted from the light-emitting part as light pulses; and the second detector having a second detector plate, on which is disposed at a predetermined position in the circumferential direction a second slit capable of transmitting light, the second detector plate provided on a second rotating member caused to rotate in the forward and reverse directions by the second motor; the second detector adapted for detecting, when the pressure-application-switching mechanism is in the applied-pressure state or the released-pressure state, whether the nip is in the applied-pressure state or the released-pressure state by detecting, using the light receiving part, changes in the light-reception status of the light emitted by the light-emitting part for a predetermined period of time as the second detector plate rotates.

2. The fuser device according to claim 1, the second rotating member being provided so as to be capable of rotating coaxially yet independently of the first rotating member, and the second detector plate being disposed near the first detector plate.

3. The fuser device according to claim 1, the second rotating member rotating no more than one full rotation in the forward or reverse direction.

4. The fuser device according to claim 1, the first rotating member comprising a detector gear that meshes with a gear provided on the one member; and the second rotating member comprising a gear included in a gear train for transmitting rotational drive force from the second motor to the pressure-application-switching mechanism.

5. The fuser device according to claim 1, the light emitting unit and light receiving unit being disposed with the first and second detector plates interposed therebetween; and the light receiving unit receiving light passing through the first slit and receiving light passing through the second slit.

6. The fuser device according to claim 5, the width of the second slit in the circumferential direction being equal to or greater than the width of the first slit in the circumferential direction.

7. The fuser device according to claim 1, the heating means comprising an inductive heating unit having a coil for generating an electromagnetic flux for inductively heating the heating member, the coil being wrapped in a loop around the heating member in the lengthwise direction, and a magnetic core for guiding the electromagnetic flux to an inductive heat-generating layer of the heating member, the magnetic core being disposed near the coil.

8. An image forming apparatus comprising the fuser device according to claim 1.

9. A fuser device comprising:

a heating member heated by heating means;

a pressure-applying member pressing against the heating member and forming a nip;

a first drive part having a first motor for rotatably driving one of the heating member and the pressure-applying member;

a pressure-application-switching mechanism capable of switching between a state in which pressure is applied to the nip and a state in which the pressure upon the nip is released;

a second drive part having a second motor rotating either in a forward direction or a reverse direction in order to switch the pressure-application-switching mechanism between the applied-pressure state and the released-pressure state;

a first detector for detecting whether the first drive part is rotating; and a second detector for detecting the forward-direction or reverse-direction rotation of the second drive part;

the first detector having a first detector plate provided on a first rotating member caused to rotate by the first motor, and a sensor for detecting the rotation of the first detector plate; and the second detector having a second detector plate provided on a second rotating member caused to rotate in the forward and reverse directions by the second motor, and the sensor for detecting changes in the rotational state of the second detector plate.

* * * * *